US010563856B2

(12) United States Patent
Xue et al.

(10) Patent No.: US 10,563,856 B2
(45) **Date of Patent: *Feb. 18, 2020**

(54) HEAT DISSIPATION STRUCTURE WITH SPLITTED CHIMNEY STRUCTURE

(71) Applicant: SIGNIFY HOLDING B.V., Eindhoven (NL)

(72) Inventors: Jian Xue, Shanghai (CN); Chengyong Lei, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/012,382

(22) Filed: Jun. 19, 2018

(65) Prior Publication Data

US 2018/0299113 A1 Oct. 18, 2018

Related U.S. Application Data

(63) Continuation of application No. 14/421,913, filed as application No. PCT/IB2013/056657 on Aug. 15, 2013, now Pat. No. 10,006,621.

(30) Foreign Application Priority Data

Aug. 17, 2012 (WO) ..... PCT/CN12/80302
Nov. 29, 2012 (WO) ..... PCT/CN12/85546

(51) Int. Cl.
*F21V 29/77* (2015.01)
*F21V 29/508* (2015.01)
(Continued)

(52) U.S. Cl.
CPC ..... *F21V 29/777* (2015.01); *F21V 29/508* (2015.01); *F21V 29/70* (2015.01);
(Continued)

(58) Field of Classification Search
CPC .... F21V 29/502; F21V 29/503; F21V 29/508; F21V 29/74; F21V 29/77; F21V 29/777; F21V 29/83; F21V 29/773; F21K 9/233
See application file for complete search history.

(56) References Cited

U.S. PATENT DOCUMENTS 8,240,885 B2 8/2012 Miller
D698,470 S 1/2014 Li et al.
(Continued)

FOREIGN PATENT DOCUMENTS

CN 202100984 U 1/2012
CN 102425734 A1 4/2012
(Continued)

OTHER PUBLICATIONS

Martin Moeck, "Description DE102010034664", Feb. 23, 2012, Patent Translate Powered by EPO and Google, pp. 1-19.*

*Primary Examiner* — Alan B Cariaso
(74) *Attorney, Agent, or Firm* — Daniel J. Piotrowski

(57) ABSTRACT

A heat dissipation structure (2) for a lighting device (1) is provided. The heat dissipation structure comprises at least two separate heat sinks (20, 10) for a light source (3) and a driver (7) for the light source, respectively. Each heat sink comprises fins (11, 21, 22) and a wall arrangement (15, 25). The at least two separate heat sinks are disposed along an axial direction of the lighting device. The fins of the at least two separate heat sinks are enclosed by the wall arrangements to form a chimney structure (30) arranged along (such as substantially parallel with) the axial direction of the lighting device. Further, the chimney structure comprises at least two sub-chimney structures (31, 32) arranged fluidly in parallel. The sub-chimney structures provide (accelerate) two air flows in parallel within the chimney structure,
(Continued)

whereby cool air flows through the two sub-chimney structures simultaneously, which reduces heat concatenation.

14 Claims, 3 Drawing Sheets

(51) Int. Cl.

| | |
|---|---|
| ***F21V 29/83*** | (2015.01) |
| ***F21V 29/71*** | (2015.01) |
| ***F21V 29/70*** | (2015.01) |
| *F21K 9/233* | (2016.01) |
| *F21Y 115/10* | (2016.01) |
| *F21V 29/503* | (2015.01) |
| *F21Y 101/00* | (2016.01) |

(52) U.S. Cl.
CPC ..... *F21V 29/713* (2015.01); *F21V 29/83* (2015.01); *F21K 9/233* (2016.08); *F21V 29/503* (2015.01); *F21V 29/773* (2015.01); *F21Y 2101/00* (2013.01); *F21Y 2115/10* (2016.08)

(56) References Cited

U.S. PATENT DOCUMENTS

| | | | | |
|---|---|---|---|---|
| 8,858,026 | B2 * | 10/2014 | Lee | F21K 9/00 362/249.02 |
| 8,907,550 | B2 | 12/2014 | Zaderej et al. | |
| 9,239,159 | B2 | 1/2016 | Takenaka et al. | |
| 9,335,101 | B2 | 5/2016 | Achammer et al. | |
| 10,006,621 | B2 * | 6/2018 | Xue | F21V 29/004 |
| 2008/0285271 | A1 | 11/2008 | Roberge et al. | |
| 2009/0040759 | A1 | 2/2009 | Zhang et al. | |
| 2009/0296387 | A1 | 12/2009 | Reisenauer et al. | |
| 2009/0323348 | A1 | 12/2009 | Shuai et al. | |
| 2010/0282446 | A1 | 11/2010 | Yamamoto et al. | |
| 2011/0089838 | A1 | 4/2011 | Pickard et al. | |
| 2011/0309751 | A1 | 12/2011 | Ter-Hovhannisyan | |
| 2012/0057352 | A1 | 3/2012 | Wilcox et al. | |

FOREIGN PATENT DOCUMENTS

| | | | |
|---|---|---|---|
| CN | 20230377 | U | 7/2012 |
| DE | 102010034664 | A1 | 2/2012 |
| EP | 2320137 | A1 | 3/2011 |
| JP | 2009163955 | A1 | 7/2009 |
| JP | 2012504305 | A1 | 2/2012 |
| JP | 3175599 | U | 5/2012 |
| KR | 20110007971 | U | 8/2011 |
| WO | WO2010035996 | A2 | 4/2010 |
| WO | WO2012095798 | A1 | 2/2014 |
| WO | WO2014020475 | A1 | 2/2014 |

* cited by examiner

HEAT DISSIPATION STRUCTURE WITH SPLITTED CHIMNEY STRUCTURE

CROSS-REFERENCE TO PRIOR APPLICATIONS

This application is a continuation application of U.S. application Ser. No. 14/421,913, filed Feb. 16, 2015, which is a 35 U.S.C. § 371 application of International Application No. PCT/IB2013/056657, filed Aug. 15, 2013, which claims the benefit of Chinese Patent Applications Nos. PCT/CN12/85546, filed Nov. 29, 2012 and PCT/CN12/80302, filed Aug. 17, 2012. These applications are hereby incorporated by reference herein.

FIELD OF THE INVENTION

The present invention generally relates to the field of heat dissipation structures for lighting devices. In particular, the present invention relates to such heat dissipation structures comprising chimney structures for dissipating heat from lighting devices by means of convection.

BACKGROUND OF THE INVENTION

Traditional incandescent lamps are currently being replaced by more energy efficient solid state based alternatives, such as light emitting diode (LED) based lighting devices. LEDs, as well as electronics for driving the LEDs, generate heat during operation of the lighting device. However, high temperatures shorten the lifetime of the LEDs. In design of LED-based lighting devices, the thermal issue is considered to be a bottleneck that restricts optical output and lifetime of the lighting device. Some lighting devices comprise a structure able to generate a chimney effect within the lighting device in order to enhance heat dissipation from the LEDs. The chimney effect is utilized to create an air flow in the lighting device for cooling the LEDs by means of convection. An example of such a lighting device is shown in US2008/0285271.

SUMMARY OF THE INVENTION

It is an object of at least some embodiments of the present invention to provide an improved heat dissipation structure for a lighting device (or lamp). In particular, it is an object to provide a heat dissipation structure for enhancing convection cooling of the lighting device.

According to an aspect of the invention, these and other objects are achieved by means of a heat dissipation structure as defined in the independent claim. Preferable embodiments of the present invention are defined in the dependent claims.

A heat dissipation structure for a lighting device is provided. The heat dissipation structure comprises at least two separate heat sinks for a light source and a driver for the light source, respectively. Each heat sink comprises fins and a wall arrangement. The at least two separate heat sinks are disposed along an axial direction of the lighting device. The fins of the at least two separate heat sinks are enclosed by the wall arrangements to form a chimney structure arranged along (such as substantially parallel with) the axial direction of the lighting device. Further, the chimney structure comprises at least two sub-chimney structures arranged fluidly in parallel.

In conventional LED-based lighting devices, the light source and the driver have a common heat sink, whereby heat generated by the LEDs is transferred to the driver via the heat sink, which may have a negative impact on the lifetime of the driver since the driver is sensitive to high temperatures. The present invention uses the concept of having separate heat sinks for the light source and the driver, whereby transfer of heat from the light source to the driver is reduced, which is advantageous in that it increases the lifetime of the driver.

Further, separate heat sinks for (or dedicated to) the light source and the driver facilitates individual optimization in the design of each heat sink. For example, the thermal performance of the heat sink for the light source and the heat sink for the driver, respectively, may be separately optimized in order to obtain longer lifetimes for the light source and the driver, respectively. Accordingly, a more flexible design of the lighting device is allowed.

Moreover, the fins of the two separate heat sinks are enclosed by wall arrangements to form a chimney structure, i.e. a structure (or at least one channel) in which an air flow is accelerated for providing cooling of the lighting device by means of convection. In the present specification, a chimney structure means a structure (or at least one channel) in which a chimney effect can be obtained. Each one of the sub-chimney structures may be divided by the fins into a plurality of channels (arranged fluidly in parallel) together making up the sub-chimney structure.

Further, the at least two sub-chimney structures are comprised in the chimney structure and arranged fluidly in parallel with each other in order to reduce heat concatenation. Hence, the sub-chimney structures provide (accelerate) two air flows in parallel within the chimney structure, whereby cool air flows through the two sub-chimney structures simultaneously. For example, the at least two sub-chimney structures may be arranged in parallel within the chimney structure. The two sub-chimney structures provide enhanced convection cooling of the lighting device, whereby the thermal performance of the lighting device is improved.

Conventional LED-based lighting devices usually comprise a heat sink with an outer fin structure having fins protruding from the lighting device, typically at the backside of the lamp (i.e. the side of the lighting device adapted to face a lamp fixture). Such an outer fin structure may make it more difficult to retrofit the lighting device in a conventional halogen lamp fixture. The enhanced convection cooling provided by the heat dissipation structure (or heat dissipating arrangement) according to the present invention reduces the need for such an outer fin structure. In the present aspect of the invention, the fins of the heat sinks are enclosed by the wall arrangements, whereby the backside of the lighting device may have a smoother structure for facilitating retrofitting of the lighting device into a conventional halogen lamp fixture. Further, the heat dissipation structure according to the present aspect of the invention is advantageous in that enhanced convection cooling is obtained, thereby enabling the realization of compact lighting devices having a limited possible cooling area.

Further, improved thermal performance of the lighting device results in a reduced total weight of the lighting device, as the size of the heat sink structures may be reduced.

According to an embodiment of the present invention, the heat dissipation structure may further comprise a heat spreader plate adapted to be arranged between the light source and the heat sink for the light source, whereby dissipation of heat from the light source to the heat sink for the light source is enhanced. Thus, the heat spreader plate may be adapted to conduct heat from the light source to the heat sink for the light source. The light source may be arranged at the heat spreader plate, which in turn may be attached to (or mounted on) the heat sink for the light source. With the present embodiment, the thermal path (or heat conduction) between the light source and the heat sink for the light source is improved. The heat spreader plate may preferably comprise a material with relatively high thermal conductivity, such as graphite and/or copper, and/or a vapour chamber for further improving heat dissipation from the light source to the heat sink for the light source.

According to an embodiment of the present invention, an outer wall of the wall arrangement of the heat sink for the driver may form a partition wall between the two sub-chimney structures. Hence, the outer wall of the heat sink for the driver divides the chimney structure into the two sub-chimney structures. By the term "outer wall" it is meant a wall arranged in the outer part (or circumference) of the wall arrangement and not just a wall surface facing outwards from the lighting device.

According to an embodiment of the present invention, an outer wall of the wall arrangement of the heat sink for the driver and an outer wall of the wall arrangement of the heat sink for the light source together define one of the sub-chimney structures. For example, the outer circumference of the heat sink for the light source may be larger than the outer circumference of the heat sink for the driver, wherein the heat sink for the light source may be arranged to (partially) surround the heat sink for the driver. Hence, the heat sinks may be arranged such that they partially overlap each other in an axial direction. With the present embodiment, an air flow accelerated in the sub-chimney structure is guided between the outer wall of the wall arrangement of the heat sink for the driver and the outer wall of the wall arrangement of the heat sink for the light source.

According to an embodiment of the present invention, the sub-chimney structure defined between the outer wall of the wall arrangement of the heat sink for the driver and the outer wall of the wall arrangement of the heat sink for the light source may be disposed outside of the other sub-chimney structure relative to the center of the heat dissipation structure.

According to an embodiment of the present invention, the wall arrangement of the heat sink for the driver may define at least a portion of one of the sub-chimney structures. For example, one of the sub-chimney structures may be defined between an inner wall and an outer wall of the wall arrangement of the heat sink for the driver. The present embodiment is advantageous in that an air flow generated in the sub-chimney structure passes through the heat sink for the driver, thereby cooling the driver by means of convection. By the term "inner wall" it is meant a wall arranged in the inner region of the wall arrangement and not just a wall surface facing inwards from the lighting device.

In an embodiment, the sub-chimney structure defined at least partly by the wall arrangement of the heat sink for the driver may be disposed on the inside of the other sub-chimney structure relative to the center of the heat dissipation structure.

According to an embodiment of the present invention, the wall arrangement of the heat sink for the driver may have at least one aperture forming an outlet for one of the sub-chimney structures. Hence, the air flow induced in the sub-chimney structure may exit the lighting device via the aperture. The at least one aperture may e.g. be disposed in the outer wall of the heat sink for the driver.

According to an embodiment of the present invention, the wall arrangement of the heat sink for the light source may have at least one aperture forming an inlet for the chimney structure. The air flow induced in the chimney structure may enter the lighting device via the aperture in the heat sink for the light source. The at least one aperture in the heat sink for the light source may e.g. be defined between an outer wall and an inner wall of the heat sink for the light source. The two sub-chimney structures may have a common inlet via the aperture in the heat sink for the light source.

According to an embodiment of the present invention, the wall arrangement of the heat sink for the driver may have at least one aperture through which at least one of the fins of the heat sink for the light source may extend from one of the sub-chimney structures into the other one of the sub-chimney structures (such as from the outer one to the inner one of the sub-chimney structures). In the present embodiment, the fin extending between the sub-chimney structures may be cooled by the air flows induced in both sub-chimney structures, which improves heat dissipation from the light source. Preferably, the at least one fin of the heat sink structure may extend through the aperture of the heat sink for the driver without being in physical contact with the heat sink for the driver, whereby transfer of heat between the heat sinks via physical contact is reduced, which is advantageous in that heat transfer from the light source to the driver is reduced.

According to an embodiment of the present invention, the heat sink structure for the light source and the heat sink structure for the driver may be thermally isolated from each other, thereby reducing heat transfer from the light source to the driver. By the term "thermally isolated" it is meant that heat conductive portions of one of the heat sinks (such as portions of the heat sink comprising metal or any other material with relatively high thermal conductivity) are not in direct physical contact with heat conductive portions of the other one of the heat sinks. The heat sinks may at some point be physically connected to each other, but the physical connection may preferably be provided via a material with low thermal conductivity, such as plastics or ceramics.

According to an embodiment of the present invention, the wall arrangement of the heat sink for the light source may surround the wall arrangement of the heat sink for the driver. Hence, the wall arrangement of the heat sink for the light source may be arranged outside the wall arrangement of the heat sink for the driver, relative to the center of the heat dissipation structure.

According to an embodiment, the two sub-chimney structures may be for the two heat sinks, respectively. Hence, one of the sub-chimney structures may be arranged to dissipate heat from heat sinks for the driver, and the other one of the sub-chimney structures may be arranged to dissipate heat from heat sinks for the light source.

According to an embodiment of the present invention, a lighting device is provided. The lighting device comprises a heat dissipation structure as defined in any one of the preceding embodiments.

It is noted that the invention relates to all possible combinations of features recited in the claims. Further objectives of, features of, and advantages with, the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

This and other aspects of the present invention will now be described in more detail, with reference to the appended drawings showing embodiments of the invention.

All the figures are schematic, not necessarily to scale, and generally only show parts which are necessary in order to elucidate the invention, wherein other parts may be omitted or merely suggested.

DETAILED DESCRIPTION

With reference to FIGS. 1 to 4, a lighting device 1 comprising a heat dissipation structure 2 according to an embodiment of the present invention will be described.

Figure 1:
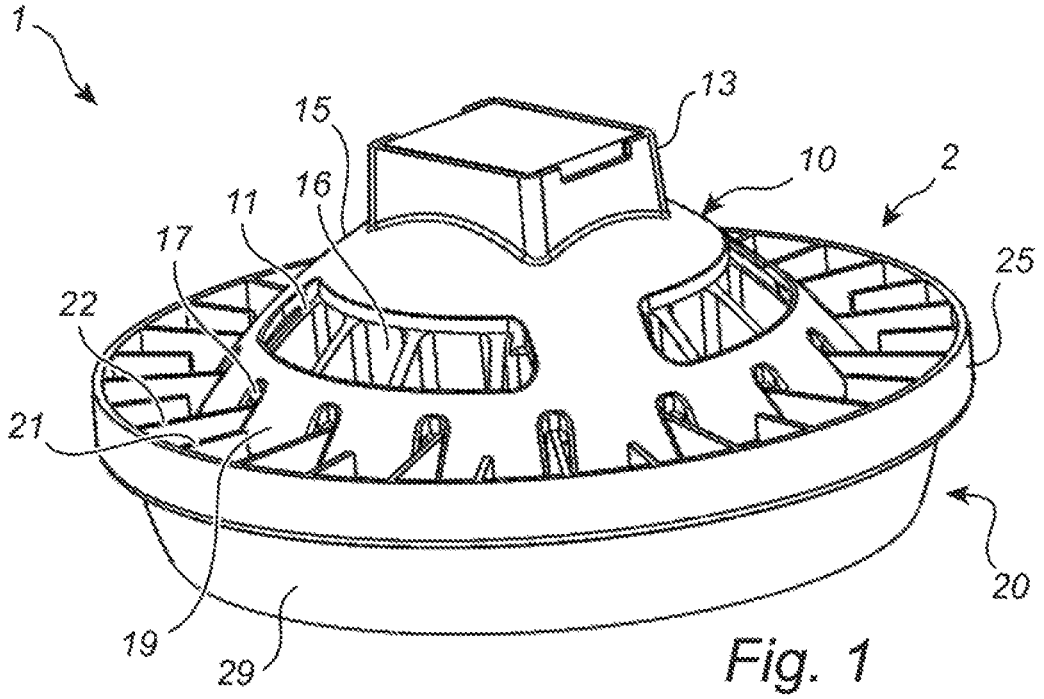
FIG. 1 is a perspective view of a lighting device according to an embodiment of the present invention.
Figure 2:
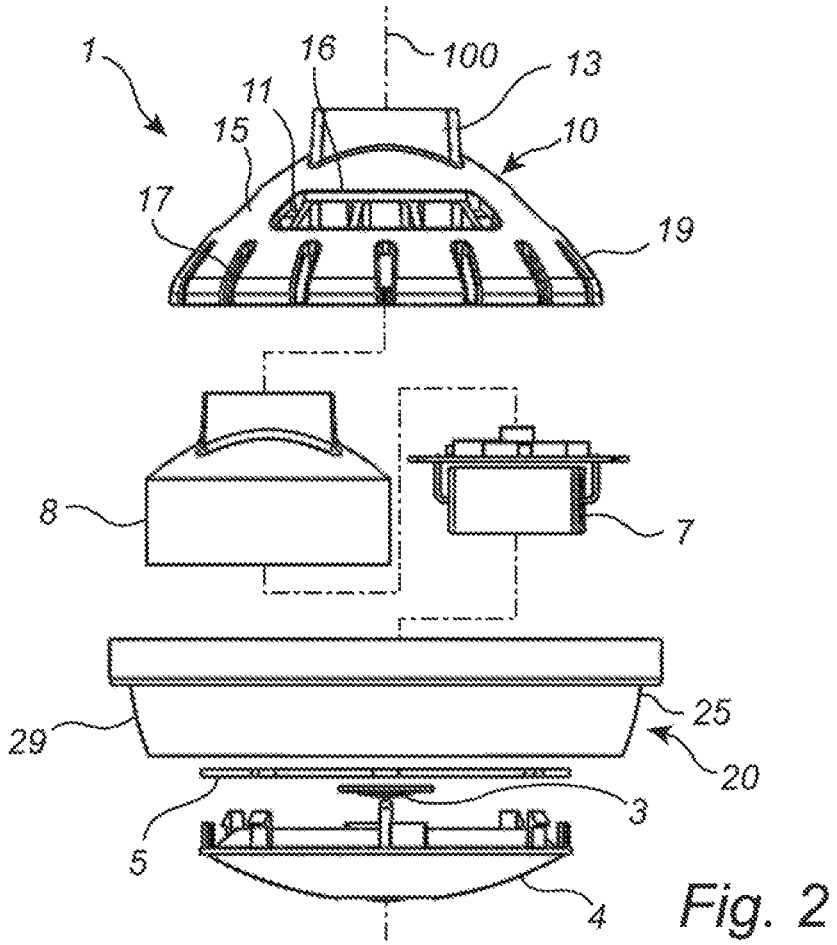
FIG. 2 is an exploded view of the lighting device shown in FIG. 1.

The lighting device 1 comprises at least one light source 3 and electronics 7 for driving the light source 3 (in the following referred to as the driver 7), as shown in FIG. 2. The driver 7 may be encapsulated in potting (or pottant) for protection against moisture and shocks, and supported in a housing (or holder) 8. The light source 3 may be a solid state based light source, such as a light emitting diode (LED). Optionally, a lens 4 or an optical cover may be arranged to enclose the light source 3 in the lighting device 1.

The heat dissipation structure 2 of the lighting device 1 is configured to dissipate heat from the lighting device 1. The heat dissipating structure 2 comprises a heat sink 10 for dissipating heat from the driver 7 (in the following referred to as the driver heat sink) and a heat sink 20 for dissipating heat from the light source 3 (in the following referred to as the light source heat sink). The driver heat sink 10 and the light source heat sink 20 are separately arranged along a (common) axial direction 100 of the lighting device 1. The axial direction 100 may correspond to an optical axis of the lighting device 1. Hence, the optical axis of the lighting device 100 may coincide with an axial direction of the light source heat sink 20 as well as an axial direction of the driver heat sink. The driver heat sink 10 may be adapted to be fitted in a lamp fitting and forms the back of the lighting device 1 (i.e. the portion or side of the lighting device 1 facing the lamp fitting and away from the region to be illuminated by the lighting device 1). The light source heat sink 20 forms the front of the lighting device 1 and faces the region to be illuminated by the lighting device 1. For example, the light source heat sink 20 may extend (or stick out) in front of the lighting device 1.

Preferably, the heat sinks 10, 20 may be thermally isolated from each other, or at least only thermally connected at a few points with a relatively small physical contact area between the heat sinks 10, 20 for reducing transfer of heat between the heat sinks 10, 20. For example, the heat sinks 10, 20 may be interconnected via connections 6. The heat sinks 10, 20 are preferably made of a material with a relatively high thermal conductivity, such as metal.

Figure 3:
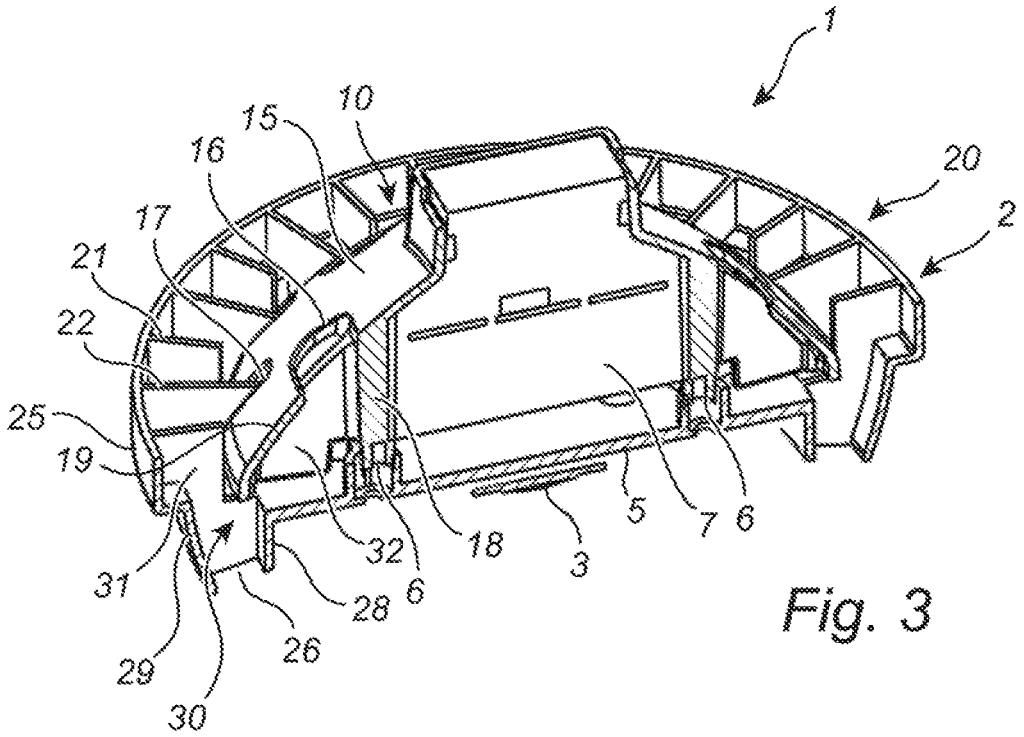
FIG. 3 is a cross-sectional view of the lighting device shown in FIG. 1.
Figure 4:
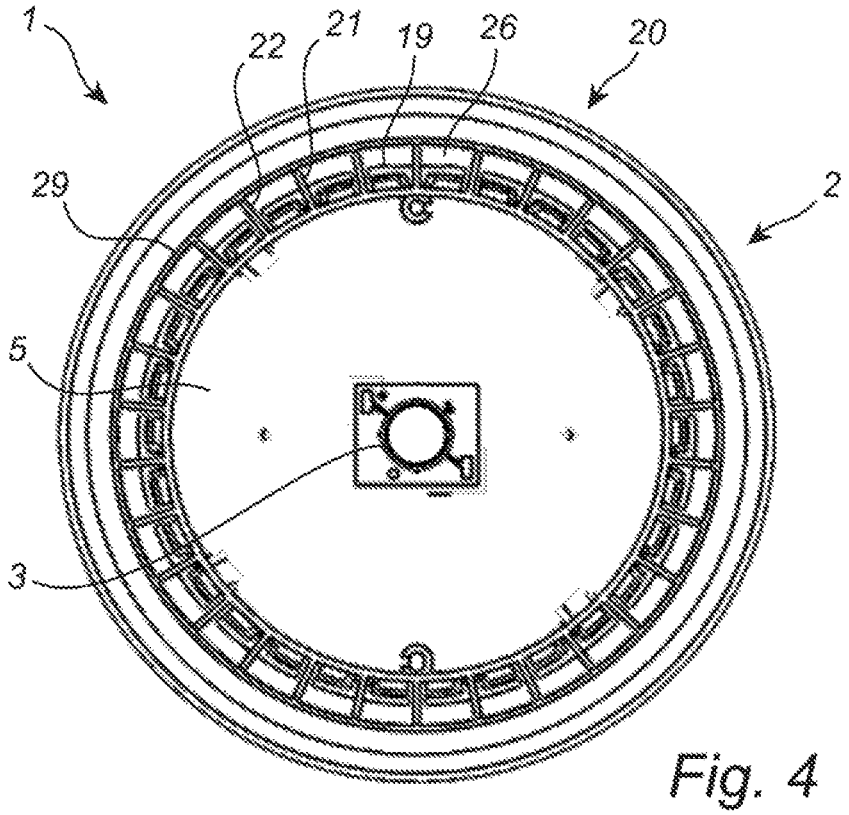
FIG. 4 is a bottom view of the lighting device shown in FIG. 1.

The driver heat sink 10 comprises fins 11 at least partially enclosed by a wall arrangement 15 (or wall structure). For example, the fins 11 and the wall arrangement 15 may together define the driver heat sink 10. The fins 11 may preferably extend in a radial direction of the lighting device 1 (i.e. transverse to the axial direction 100 of the lighting device 1) between the walls of the wall arrangement 15. The wall arrangement 15 of the driver heat sink 10 comprises an outer wall 19 arranged on the outside of the fins 11 (relative to a center of the heat dissipating structure 2) and an inner wall 18 arranged on the inside of the fins 11 (relative to a center of the heat dissipating structure 2), as shown in FIG. 3. Hence, the outer wall 19 and the inner wall 18 together enclose (or surround) the fins 11. The outer wall 19 of the driver heat sink 10 may preferably have a smooth outer surface in order to facilitate retrofitting the lighting device 1 in conventional halogen lamp fittings. Further, one or more apertures (or holes) 16 are defined in the outer wall 19 of the driver heat sink 10. The apertures 16 may preferably extend circumferentially in the outer wall 19 (i.e. transverse to the axial direction 100 of the lighting device 1). The outer wall 19 of the driver heat sink 10 further comprises one or more apertures 17, preferably extending along the axial direction 100 of the lighting device 1. Preferably, the apertures 17 may be arranged as slits in an edge of the outer wall 19 facing the light source heat sink 20.

The light source heat sink 20 also comprises fins 21, 22 at least partially enclosed by a wall arrangement 25 (or wall structure). For example, the fins 21, 22 and the wall arrangement 25 may together define the light source heat sink 20. The fins 21, 22 may preferably extend in a radial direction of the lighting device 1 between the walls of the wall arrangement 25. The wall arrangement 25 of the light source heat sink 20 comprises an outer wall 29 arranged on the outside of the fins 21, 22 and an inner wall 28 arranged on the inside of the fins 21, 22, relative to a center of the heat dissipating structure 2, as shown in FIG. 3. Hence, the outer wall 29 and the inner wall 28 together enclose (or surround) the fins 21, 22. Preferably, one or more of the fins 22 may extend through the apertures 17 at the edge of the outer wall 19 of the driver heat sink 20 without coming into physical contact with the outer wall 19 of the driver heat sink 10. Hence, the fins 22 of the light source heat sink 20 may extend into the driver heat sink 20. For example, the fins 22 extending through the apertures 17 may be alternately arranged with the fins 21 of the light source heat sink 20 not extending through the apertures 17.

The light source 3 is arranged on a heat spreader plate 5 mounted to the inner circumference of the inner wall 28 of the light source heat sink 20. The heat spreader plate 5 may preferably comprise a material with relatively high thermal conductivity, such as graphite and/or copper, and/or a vapour chamber. Thus, the heat spreader plate 5 thermally connects the light source 3 with the light source heat sink 20, whereby heat generated by the light source 3 during operation is dissipated via the heat spreader plate 5 to the light source heat sink 20. The light source heat sink 20 may be physically connected to the driver heat sink 10 via the heat spreader plate 5, at which the connections 6 may be arranged.

The circumference of the driver heat sink 10 is smaller than the circumference of the light source heat sink 20, which allows the two heat sinks 10, 20 to be arranged to partially overlap each other in the axial direction 100. For example, the wall arrangement 25 of the light source heat sink 20 may be ring-shaped and the driver heat sink 10 may be dome-shaped so as to fit within the inner circumference of the ring-shaped wall structure 25 of the light source heat sink 20. The heat sinks 10, 20 are arranged such that the wall arrangements 15, 25 and the fins 11, 21, 22 define a chimney (channel) structure 30 in the heat dissipation structure 2. The chimney structure 30 has a portion divided into two sub-chimney (or sub-channel) structures 31, 32, which portion also may be referred to as a splitted chimney structure. One of the sub-chimney structures 31 is defined between the outer wall 29 of the light source heat sink 20 and the outer wall 19 of the driver heat sink 10, which sub-chimney structure 31 may be referred to as the outer sub-chimney structure (relative to the center of the heat dissipating structure 2). The other one of the sub-chimney structures 32 is defined between the outer wall 19 and the inner wall 18 of the driver heat sink 10, which sub-chimney structure 31 may be referred to as the inner sub-chimney structure (relative to the center of the heat dissipating structure 2). Hence, the outer wall 19 of the driver heat sink 10 forms a partition wall between the two sub-chimney structures 31, 32. An inlet of the chimney structure 30 is defined in an aperture 26 between the inner and outer walls 28, 29 of the light source heat sink 20. Further, the aperture 16 in the outer wall 19 of the driver heat sink 10 forms an outlet of the inner sub-chimney structure 32. The outlet of the outer sub-chimney structure 31 is defined in an aperture between the outer wall 29 of the light source heat sink 20 and the outer wall 19 of the driver heat sink 10.

Figure 5:
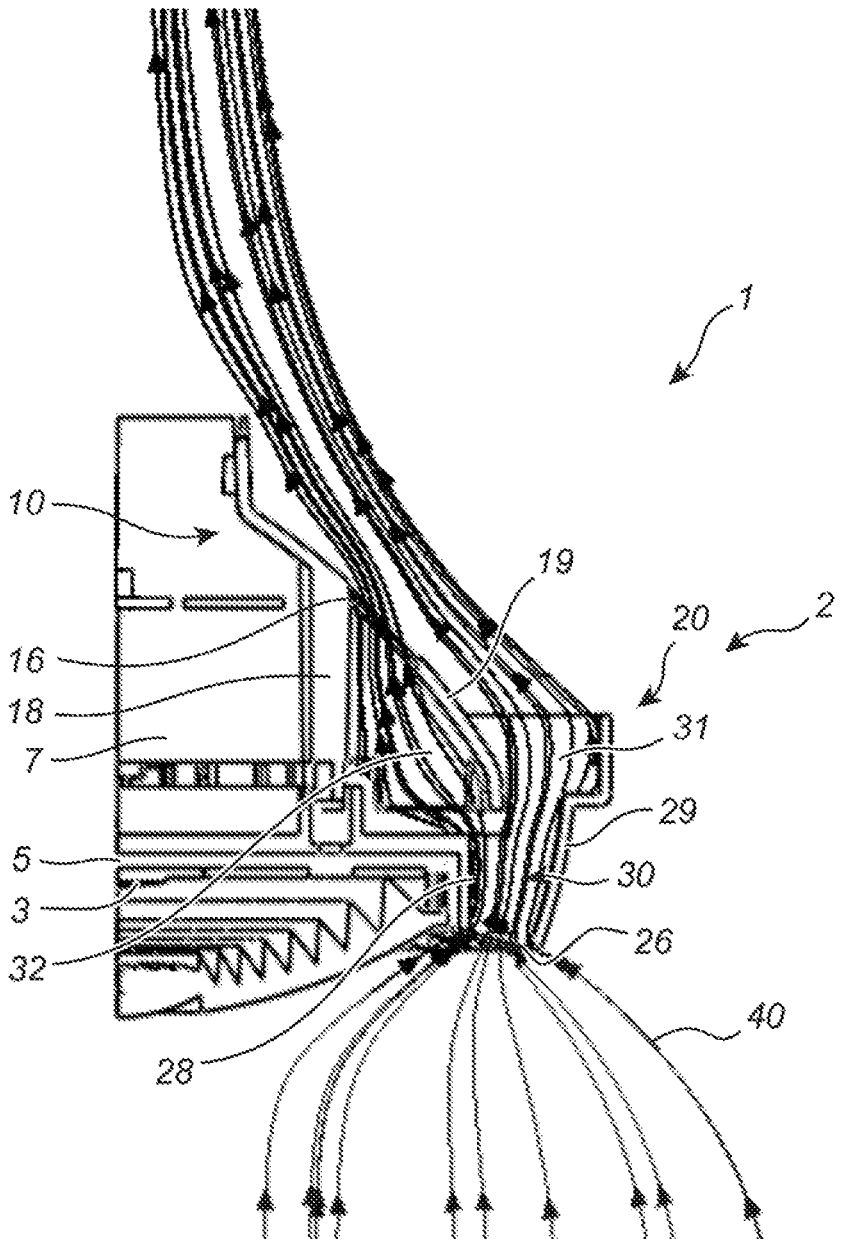
FIG. 5 illustrates an air flow induced in a chimney structure of the lighting device shown in FIG. 1.

With reference to FIG. 5, the function of the heat dissipation structure 2 will be described.

When the lighting device 1 is operated, heat is generated by the light source 3 and dissipated via the heat dissipation plate 5 to the light source heat sink 20. Heat is also generated by the driver 7 and dissipated (e.g. via the potting and the housing) to the driver heat sink 10. Thus, the heat sinks 10, 20 become warm by the heat from the driver 7 and the light source 3, respectively, which in turn warms up the air inside the chimney structure 30. The temperature difference between air inside the chimney structure 30 and the ambient air outside the chimney structure 30 induces an air flow through the chimney structure 30, as indicated by arrows 40. The air flow enters the chimney structure 30 at the inlet aperture 26 in the wall arrangement of the light source heat sink 20 and is then divided by the outer wall 19 of the driver heat sink 10 into two parallel air flows in the two sub-chimney structures 31, 32. Hence, the sub-chimney structures 31, 32 are arranged fluidly in parallel with each other. Finally, the air flow in the inner sub-chimney structure 32 exits the heat dissipation structure via the outlet aperture 16 in the outer wall 19 of the driver heat sink 10 and the air flow in the outer sub-chimney structure 32 exits the heat dissipation structure via the outlet aperture defined between the outer wall 19 of the driver heat sink 10 and the outer wall 29 of the light source heat sink 20.

The air flow in the chimney structure 30 cools the driver heat sink 10 and the light source heat sink 20 mainly by means of convection. The air flow in the inner sub-chimney structure 32 cools the driver heat sink 10, as it flows through the wall arrangement and between the fins of the driver heat sink 10. Further, the air flow in the outer sub-chimney structure primarily cools the light source heat sink 20, as it flows through the wall arrangement and between the fins of the light source heat sink 20, but it also cools the driver heat sink 10, as it flows along the outer wall 19 of the driver heat sink 10. As the sub-chimney structures 31, 32 accelerate two air flows in parallel within the chimney structure 30, cool fresh air flows through the two sub-chimney structures simultaneously.

With the present embodiment, temperature at a mid portion of the heat spreader plate 5 may be around 76° C., which is lower than the temperature at the corresponding location in a prior art lighting device, which may be around 81° C. Hence, the heat dissipation obtained by the present embodiment is improved compared to prior art heat dissipation structures.

In the following, further embodiments of the present invention will be described.

The present embodiment discloses that the separate heat sink structure applied on a kind of directional LED lamp can allow flexible heat sink design of the driver and LED in the lamp. Meanwhile the two heat sinks form two chimneys in parallel, which can gain optimum air convection efficiency. Furthermore, a kind of high thermal conductivity material application can decrease the spreading thermal resistance from the centre to the circumference of the heat sink significantly. All the considerations can benefit greatly to the thermal management. Accordingly, it is significantly helpful to lifetime, cost down and weight down.

LED lamps have been regarded as the future of light sources and have been spreading worldwide in the recent years, and will be even more and more popular in the future to replace traditional lamps for the feature of high efficacy and potential long lifetime. The thermal issue is considered to be bottleneck that restricts optical output and lifetime. This embodiment is for a kind of compact led lamps. To avoid the installation interference with luminaire, the backside of the lamp is kept in check line as traditional lamp, while the front side sticks out to compensate the cooling area. Based on such mechanical structure, apply a novel chimney cooling structure not only can decrease thermal resistant from the whole lamp to the ambient, but also make convection channel flexible and adjustable in aims to allocate air flow reasonably. Such heat dissipation solution can improve thermal performance significantly, which also improves optical output, safety and lifetime of LED lamps and finally benefit the development of LED lamp.

There are five issues of limitation for conventional directional reflector LED lamp which are shown as below:

- For most LED retrofit lamp, the backside is used for heat sink design to compensate the cooling area. But it is easy to interfere with some luminaires so that cause installation issue.
- For conventional directional reflector LED lamp, an integrated heat sink for heat dissipation design is used. That means driver part and LED part share one heat sink, the heat power from LED can easily transfer to driver part by heat sink, so the heat dissipation condition of driver is impacted by LED part adversely, hereby the thermal performance of driver part become worse. Consequently, the lifetime of lamp is restricted.
- For most conventional LED lamps with passive cooling, heat sink is outer fin structure which has worse radiation effect and less potential for convection optimization. Such disadvantages are more apparent in compact LED lamps due to the very limited size requirement.
- For conventional LED lamp with single vertical fin structure, it is easy to cause heat concatenation effect which can deteriorate the heat dissipation efficiency of top components. So such structure lacks feasibility on heat dissipation.
- In conventional thermal design with dot heat source, the dot heat source located on the PCB directly touches the heat sink base. Such design can generate large spreading thermal resistance from dot heat source to the heat sink outside, which will decrease the heat sink efficiency tremendously.

Due to the disadvantages of conventional LED lamps, the present embodiment uses the concept of a double splitted chimney structure, which can improve thermal performance significantly and also make heat dissipation path more flexible. See the structure as below:

In the present embodiment, the back side is kept in check line as a halogen lamp, which can avoid the interference with luminaire, while the front side of the lamp sticks out in order to compensate the cooling area, besides that, such protruding part can play a chimney effect as well which benefit the heat dissipation.

In the separate heat sink structure, there are two heat sinks for LED and driver respectively, which is more flexible and controllable for heat dissipation of LED and driver. For example, the thermal performance of driver is improved without obvious impact to LED during the design phase, and vice versa. Base on such concept, the thermal performance for LED and driver, respectively, may be optimized so that improved performance and lifetime are obtained. This allows a flexible design of the lamp.

In the present embodiment, the fins are enclosed by wall structure to generate the chimney structure, which can accelerate the air flow speed such that the convection is enhanced. Such structure benefits the heat dissipation especially for the compact lamp that lacks cooling area.

Based on the splitted structure, two chimney structures are formed. The two chimneys are in parallel in order to avoid heat concatenation. In this design, the fresh cool air can go through the chimney of driver and L2 (light source) at the same time so that cooling efficiency is enhanced.

Furthermore, a heat spreader plate can be added between the point heat source (LED) and the heat sink base in order to decrease the spreading thermal resistance from the centre to the circumference of the heat sink. Such plate is made of high thermal conductivity material, such as graphite, copper or vapour chamber.

With the above considerations on design, a double splitted chimney structure can provide lower thermal resistance, improve cooling efficacy and reduce weight.

Generally speaking, some performance improvement can be gained as below:

Fit to more luminaires

Thermal resistance can be lower than 2 K/W

Lamp volume can be e.g. 10% smaller

In the present design, the final target is to improve thermal performance for the whole system, in which the chimney structure plays an important role. A design step may be to determine the (optimal) chimney parameters, e.g. the chimney height and the diameter of each chimney element.

Based on the outline restrictions of the lamp system, the chimney height is usually a constant. The chimney diameter (D) and chimney surface temperature ($T_{sink}$) can be assumed as constants firstly.

Secondly, the average temperature of air flow in the chimney ($\Delta T_{avg}$) can be obtained and accordingly the buoyancy and the pressure losses of the chimney can be derived. So far, the real working point of air flow through the chimney structure can be derived.

Thirdly, the heat removed by the chimney effect can be derived. Meanwhile, the heat removed by convection and radiation can be calculated.

Finally, thermal resistance of the lamp system can be obtained through what was derived above. The best thermal performance means the lowest system thermal resistance. So the optimal (or at least an improved) chimney diameter can be derived theoretically.

During the chimney structure design, it is assumed that the whole heat sink keeps uniform temperature in order to simplify the system design. But actually there could be thermal conductivity resistance in the heat sink, especially the spreading resistance from dot heat source to the convection boundary with ambient.

In this design, a kind of high thermal conductivity material may be applied between the dot heat source and the heat sink bottom to decrease the heat spreading resistance.

Itemized List of Embodiments

1. A heat dissipation structure for a lighting device, which heat dissipation structure comprising:

at least two separate heat sinks for a light source and a driver for the light source, respectively;

wherein the at least two separate heat sinks are disposed along an axial direction of the lighting device, and fins of the at least two separate heat sinks are enclosed by wall structures to form a chimney structure which is substantially parallel to the axial direction of the lighting device, so as to accelerate air flow there through; and wherein, at least two sub-chimney structures are provided in parallel within the chimney structure, for the at least two separate heat sinks respectively, so as to minimize heat concatenation between the at least two separate heat sinks.

2. The heat dissipation structure according to item 1, further comprising a heat spreader plate provided between the light source and the heat sink for the light source.

3. A lighting device comprising the heat dissipation structure according to any one of items 1-2.

While embodiments of the invention have been illustrated and described in detail in the drawings and foregoing description, such illustration and description are to be considered illustrative or exemplary and not restrictive; the invention is not limited to the disclosed embodiments.

Variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A heat dissipation structure for a lighting device, which heat dissipation structure comprises:

at least two separate heat sinks, one dedicated for a light source and one dedicated for a driver for the light source, each heat sink comprising fins and a wall arrangement, wherein said at least two separate heat sinks are disposed along an axial direction of the lighting device, wherein the fins of said at least two separate heat sinks are enclosed by the wall arrangements to form a chimney structure arranged along said axial direction of the lighting device, and wherein the chimney structure comprises at least two sub-chimney structures arranged fluidly in parallel, wherein an outer wall of the wall arrangement of the heat sink for the driver forms a partition wall between the two sub-chimney structures.

2. The heat dissipation structure as defined in claim 1, further comprising a heat spreader plate adapted to be arranged between the light source and the heat sink for the light source.

3. The heat dissipation structure as defined in claim 2, wherein the heat spreader plate is adapted to conduct heat from the light source to the heat sink for the light source.

4. The heat dissipation structure as defined in claim 3, wherein an outer wall of the wall arrangement of the heat sink for the driver and an outer wall of the wall arrangement of the heat sink for the light source together define one of the sub-chimney structures.

5. The heat dissipation structure as defined in claim 4, wherein the sub-chimney structure defined between the outer wall of the wall arrangement of the heat sink for the driver and the outer wall of the wall arrangement of the heat sink for the light source is disposed outside of the other sub-chimney structure relative to the center of the heat dissipation structure.

6. The heat dissipation structure as defined in claim 5, wherein the wall arrangement of the heat sink for the driver defines at least a portion of one of the sub-chimney structures.

7. The heat dissipation structure as defined in claim 6, wherein the sub-chimney structure defined at least partly by the wall arrangement of the heat sink for the driver is disposed on the inside of the other sub-chimney structure relative to the center of the heat dissipation structure.

8. The heat dissipation structure as defined in claim 1, wherein the wall arrangement of the heat sink for the driver has at least one aperture forming an outlet for one of the sub-chimney structures.

9. The heat dissipation structure as defined in claim 1, wherein the wall arrangement of the heat sink for the light source has at least one aperture forming an inlet for the chimney structure.

10. The heat dissipation structure as defined in claim 1, wherein the wall arrangement of the heat sink for the driver has at least one aperture through which at least one of the fins of the heat sink for the light source extends from one of the sub-chimney structures into the other one of the sub-chimney structures.

11. The heat dissipation structure as defined in claim 1, wherein the heat sink structure for the light source and the heat sink structure for the driver are thermally isolated from each other.

12. The heat dissipation structure as defined in claim 11, wherein the wall arrangement of the heat sink for the light source surrounds the wall arrangement of the heat sink for the driver.

13. The heat dissipation structure as defined in claim 1, wherein the two sub-chimney structures are for the two heat sinks, respectively.

14. A lighting device comprising a heat dissipation structure as defined in claim 1.

* * * * *